US009941571B2

(12) United States Patent
Owen et al.

(10) Patent No.: US 9,941,571 B2
(45) Date of Patent: Apr. 10, 2018

(54) RADIATING ELEMENT CLAMP WITH INTEGRATED CABLE GUIDE

(71) Applicant: CommScope Technologies LLC, Hickory, NC (US)

(72) Inventors: Martin A. Owen, Blaxland (AU); Tiansong Hou, Zetland (AU); Arnold A. Peregrino, Northryde (AU)

(73) Assignee: CommScope Technologies LLC, Hickory, NC (US)

( * ) Notice: Subject to any disclaimer, the term of this patent is extended or adjusted under 35 U.S.C. 154(b) by 49 days.

(21) Appl. No.: 15/244,348

(22) Filed: Aug. 23, 2016

(65) Prior Publication Data

US 2017/0062901 A1 Mar. 2, 2017

Related U.S. Application Data

(60) Provisional application No. 62/211,106, filed on Aug. 28, 2015.

(51) Int. Cl.

| | |
|---|---|
| ***H01Q 1/12*** | (2006.01) |
| ***H01Q 1/24*** | (2006.01) |
| ***H01Q 15/14*** | (2006.01) |
| *H01Q 21/26* | (2006.01) |
| *H01Q 19/10* | (2006.01) |

(52) U.S. Cl.

CPC ..... *H01Q 1/1207* (2013.01); *H01Q 1/246* (2013.01); *H01Q 15/14* (2013.01); *H01Q 1/1242* (2013.01); *H01Q 19/108* (2013.01); *H01Q 21/26* (2013.01)

(58) Field of Classification Search

CPC ..... H01Q 1/12; H01Q 1/1207; H01Q 1/1242; H01Q 1/246; H01Q 1/50; H01Q 15/14; H01Q 19/108; H01Q 21/26

See application file for complete search history.

(56) References Cited

U.S. PATENT DOCUMENTS

2004/0201537 A1* 10/2004 Stolle ..... H01Q 1/246 343/797
2012/0038540 A1* 2/2012 Jacob ..... H01Q 1/1214 343/878
2013/0314292 A1* 11/2013 Maley ..... H01Q 1/1207 343/797

* cited by examiner

*Primary Examiner* — Robert Karacsony
(74) *Attorney, Agent, or Firm* — Myers Bigel, P.A.

(57) ABSTRACT

Aspects of the present disclosure are directed a single clamp for securing one or more radiating elements to a reflector or similar component.

8 Claims, 10 Drawing Sheets

RADIATING ELEMENT CLAMP WITH INTEGRATED CABLE GUIDE

RELATED APPLICATION

The present invention claims priority from and the benefit of U.S. Provisional Patent Application No. 62/211,106, filed Aug. 28, 2015, the disclosure of which is hereby incorporated herein in its entirety.

FIELD OF THE INVENTION

Various aspects of the present disclosure relate to base station antennae, and, more particularly, to apparatus for securing a radiating element to a reflector of a base station antenna.

BACKGROUND

Antenna for wireless voice and/or data communications typically include an array of radiating elements connected by one or more feed networks. For quality transmission and reception of Radio Frequency (RF) signals, one or more diversity techniques may be employed. One such diversity technique is polarization diversity, which may be particularly effective in combating multi-path fading. Crossed RF antenna members (forming an RF antenna element) may be used to employ polarization diversity. Each of the crossed RF antenna members may include a printed circuit board (PCB) and a radiating dipole arm extending therefrom. Each of the radiating elements may need to be secured to a reflector of the base station antenna. In some types of radiating elements, space between an element baseboard PCB and a dipole arm connected thereto is limited, making access to snap rivets difficult during assembly. Further, securing a radiating element to a reflector requires the use of many parts. Assembly and securing of the radiating element to a reflector with such a high quantity of parts and limited space may be costly and difficult to achieve.

As such, it may be advantageous to have alternative structures and techniques for securing one or more radiating elements to one or more components (e.g., a reflector) of a base station antenna.

SUMMARY

As a first aspect, embodiments of the invention are directed to

As a second aspect, embodiments of the invention are directed to

As a third aspect, embodiments of the invention are directed to

BRIEF DESCRIPTION OF THE DRAWINGS

The following detailed description of the disclosure will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown.

In the drawings.

DETAILED DESCRIPTION

Figure 1:
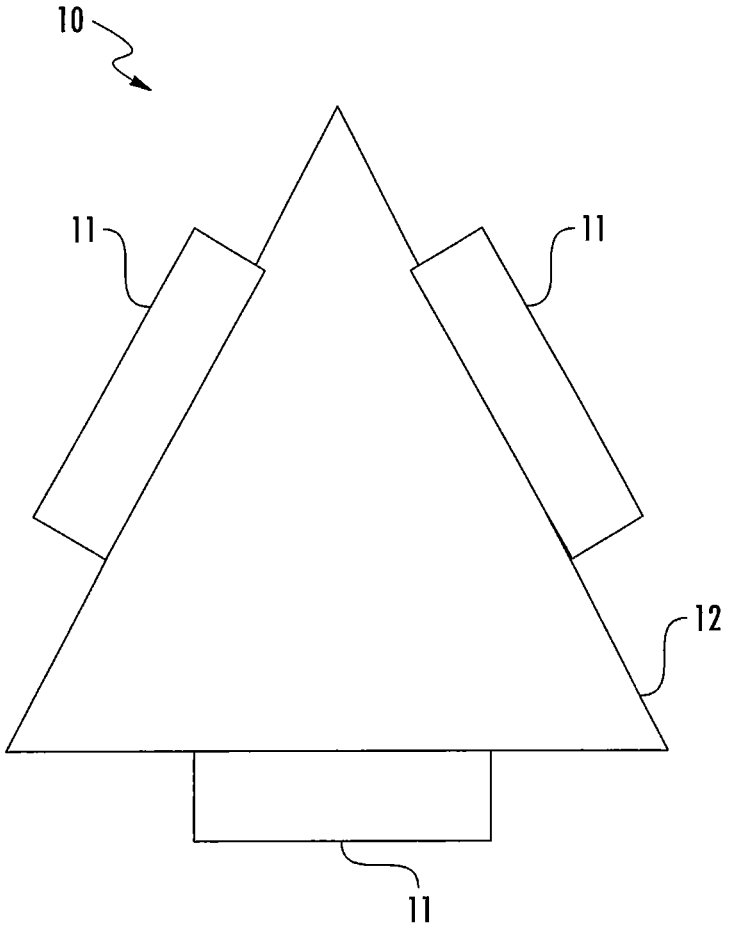
FIG. 1 is a plan view of a cell site having base station antennae, according to an embodiment of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

FIG. 1 is a plan view of a cell site 10 having base station antennae. The cell site 10 generally comprises a triangular platform 12 which may be mounted atop an antenna tower (not shown), or other suitable structure, such as a building (not shown). The platform 12 may include a first side, a second side, and a third side, each of which have a base station antenna 11.

As discussed above, a radiating element may include one or more PCBs and one or more dipole arms extending therefrom. Each of the dipole arms may serve to radiate signals from a feed network of a feedboard, through the PCB, to the environment. Aspects of the present disclosure are directed a single clamp for securing a radiating element to one or more components (e.g., a reflector) of a base station antenna.

Figure 2:
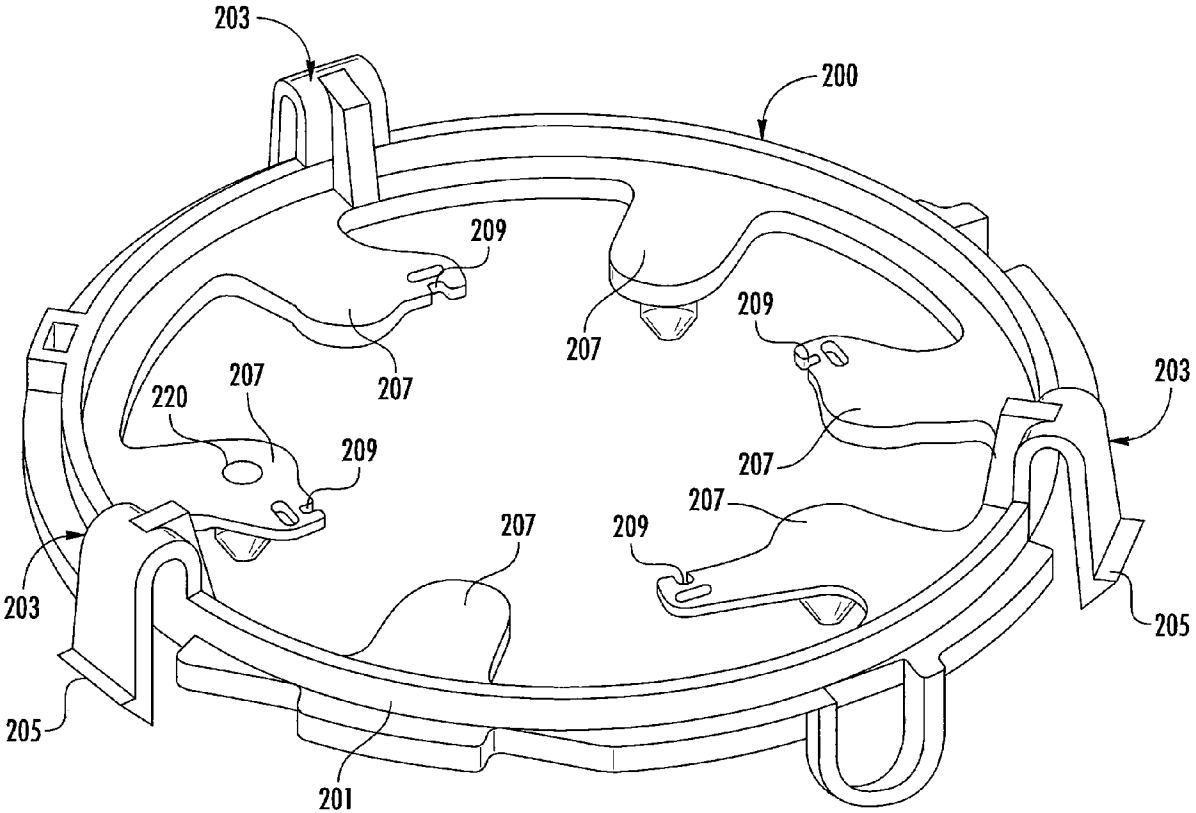
FIG. 2 is a perspective view of an inside of a top side of a clamp, according to an aspect of the present disclosure.
Figure 3:
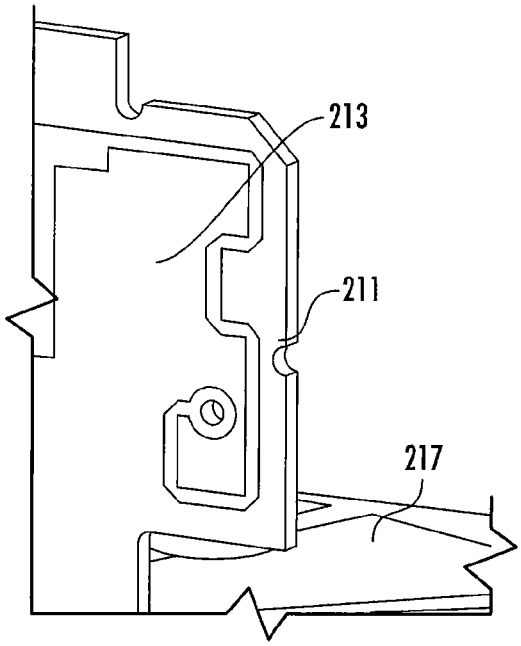
FIG. 3 is an enlarged view of a PCB, according to an aspect of the present disclosure.
Figure 4:
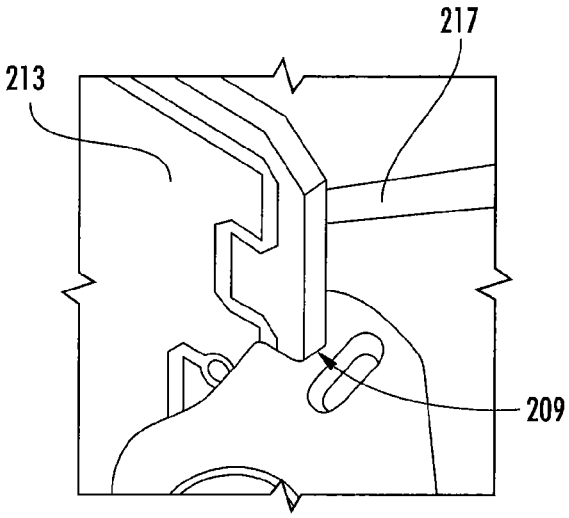
FIG. 4 is an enlarged view of the PCB engaged with a notch of the clamp during assembly, according to an aspect of the present disclosure.
Figure 5:
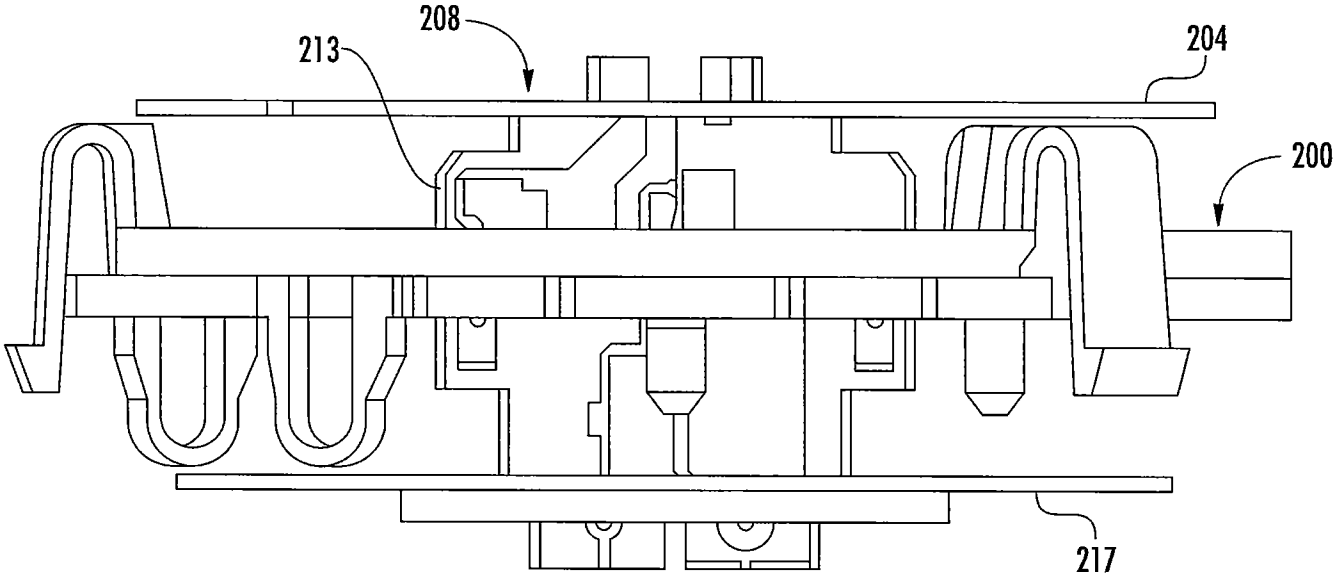
FIG. 5 is a side view of a radiating element attached to the clamp during assembly, according to an aspect of the present disclosure.
Figure 8:
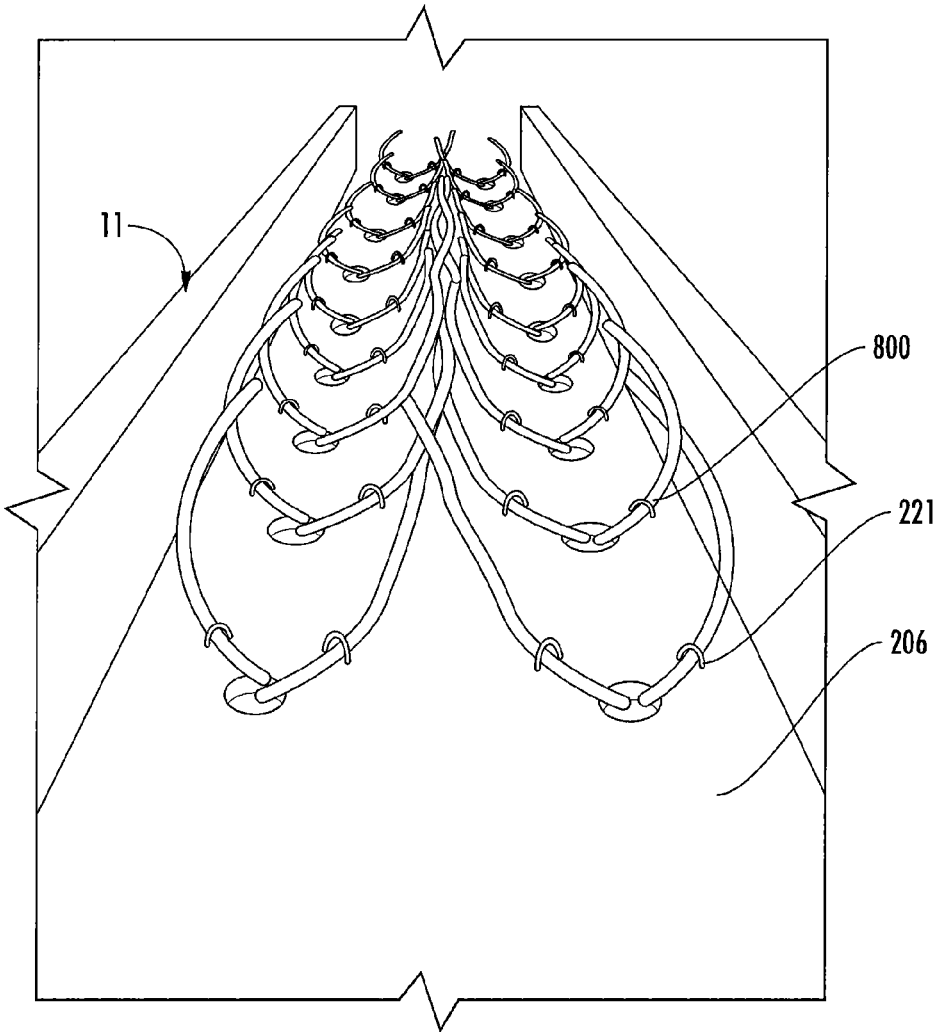
FIG. 8 is a perspective end view of an underside of the reflector having a plurality of clamps attached thereto, according to an aspect of the present disclosure.
Figure 10:
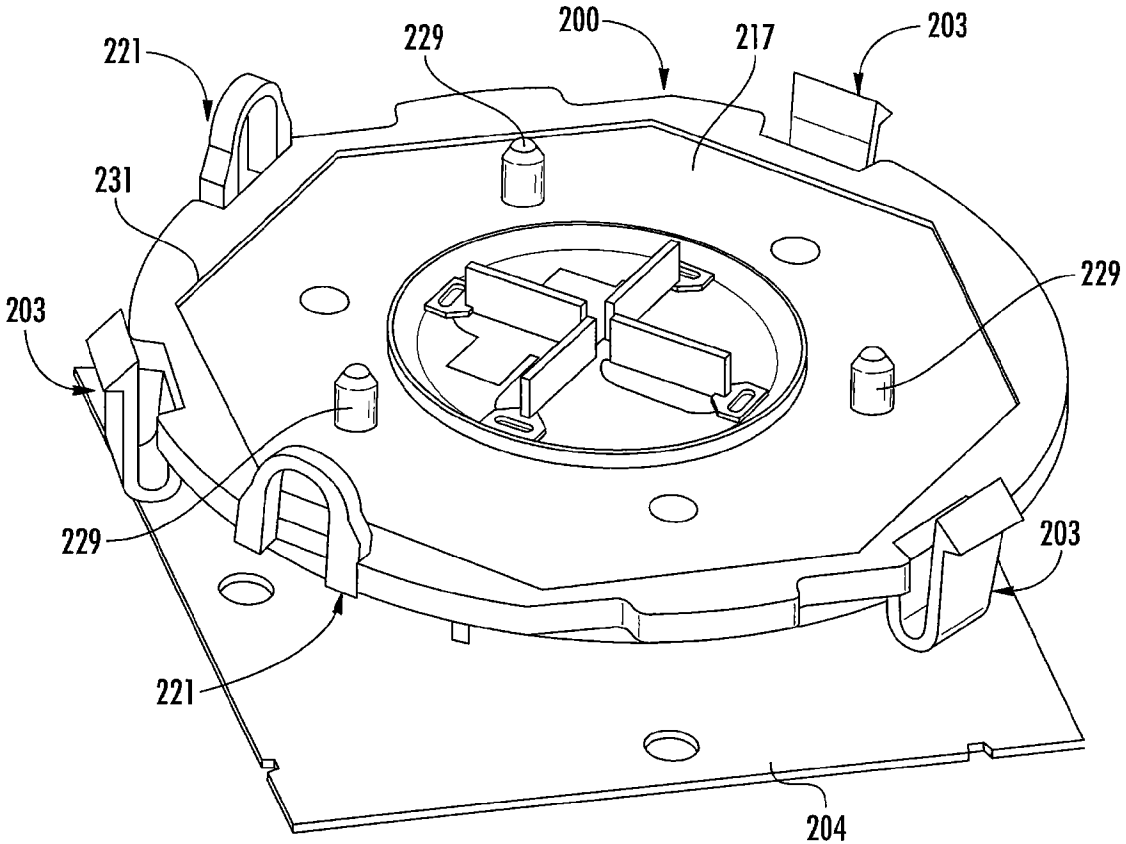
FIG. 10 is a perspective view of the underside of the clamp with the radiating element attached thereto, according to an aspect of the present disclosure.
Figure 11:
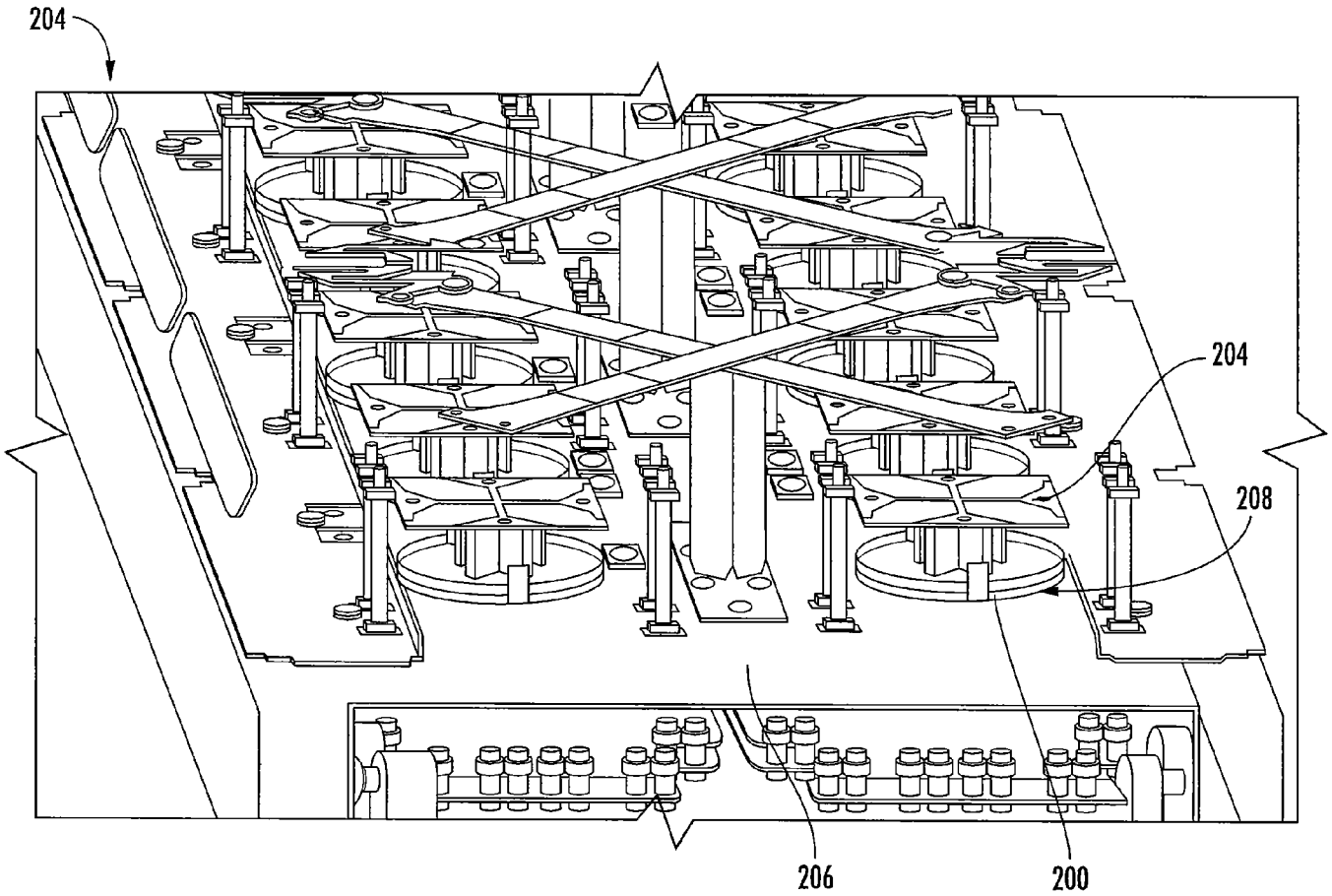
FIG. 11 is a perspective end view of an inside of an antenna with radiating elements attached to respective clamps attached to the reflector according to an aspect of the present disclosure.

FIG. 2 is a perspective view of a top side of the clamp 200 according to an aspect of the present disclosure. As used herein, the top side may refer to a side upon out of which one or more PCBs (213 as shown in FIGS. 3-6) extend along with respective dipole arms 204 (as shown in FIGS. 5, 10, and 11) and closest to a radome of the base station antenna 11. The clamp 200 may include a generally annular portion 201 and components molded or otherwise connected thereto. Along an outer periphery of the annular portion 201 are a plurality of securing members 203 configured to secure the clamp 200 to the reflector 206 (shown in FIGS. 8 and 11). The clamp 200 may be made from a thermoplastic, or other resilient plastic material.

Each of the securing members 203 may be generally u-shaped including a lip 205. A portion of each of the securing members 203 may be capable of being bent inwards (e.g., towards the center of the annular portion 201 of the clamp 200), but may be constructed to have a biased outward force (e.g. a force in a direction away from the center of the annular portion 201). As such, the portion may be bent inwards during insertion into the reflector 206, and then, because of the outward biased force, the securing member 203 may be pressed against the reflector 206, snapping, or otherwise securing the lip 205 and, in turn, the clamp 200 and radiating element 208 (as shown in FIGS. 5 and 11) against the reflector 206.

There may also exist a plurality of clamp arms 207 extending from the inner periphery to the center of the annular portion 201. A portion of one or more of the clamp arms 207 may include a holding notch 209 dimensioned to engage of a portion of the radiating element 208 during assembly. At certain times during the assembly process of the radiating element 208 and/or clamp 200 being attached thereto, one or more portions of the radiating element 208 may be subject to selective soldering (such as, for example, selective wave soldering). One or more portions of the radiating element 208 (e.g., a base board 217 shown in FIGS. 3 and 4, and/or PCB 213) may be immersed in a solder bath. To prevent the clamp 200 from being subjected to the solder bath, as shown in FIG. 4, one or more of the clamp arms 207 may include the holding notch 209 dimensioned to receive a groove or indentation 211 on one or more ends of the PCBs 213. Upon engagement, and as illustrated in the side view of the radiating element 208 attached to the clamp 200 in FIG. 5, during assembly, the clamp 200 may be held at a distance from portions of a baseboard 217 to allow sufficient clearance and isolation from portions of the radiating element 208 (e.g., baseboard 217) subject to the solder bath during selective soldering.

Figure 6:
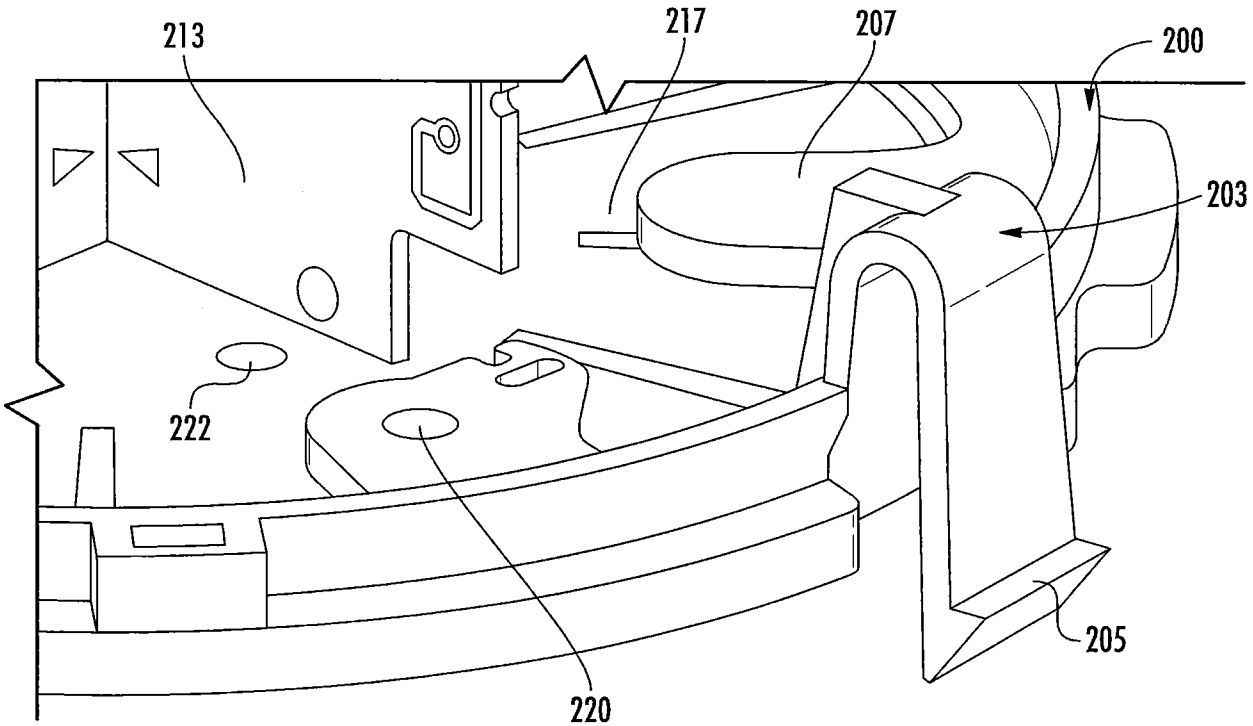
FIG. 6 is an enlarged view of the PCB aligned with a marker of the clamp, according to an aspect of the present disclosure.

Referring now to an enlarged view of the PCB 213 attached to the clamp 200 in FIG. 6, as well as FIG. 2, one of the clamp arms 207 may include a marker 220. This marker 220 may facilitate proper alignment of the radiating element 208 on the clamp 200. For example, by ensuring that the marker 220 of the clamp 200 aligns (e.g., at a similar angle) with a baseboard marker 222 on the baseboard 217 of the radiating element 208, it may be ensured that the radiating element 208 is affixed with a proper orientation on the clamp 200 and radiating element 208 on the reflector 206. Although the marker 220 is shown as being generally circular, it should be understood that the marker 220 may take the form of any shape or type of indicia in keeping with the disclosure.

Figure 7:
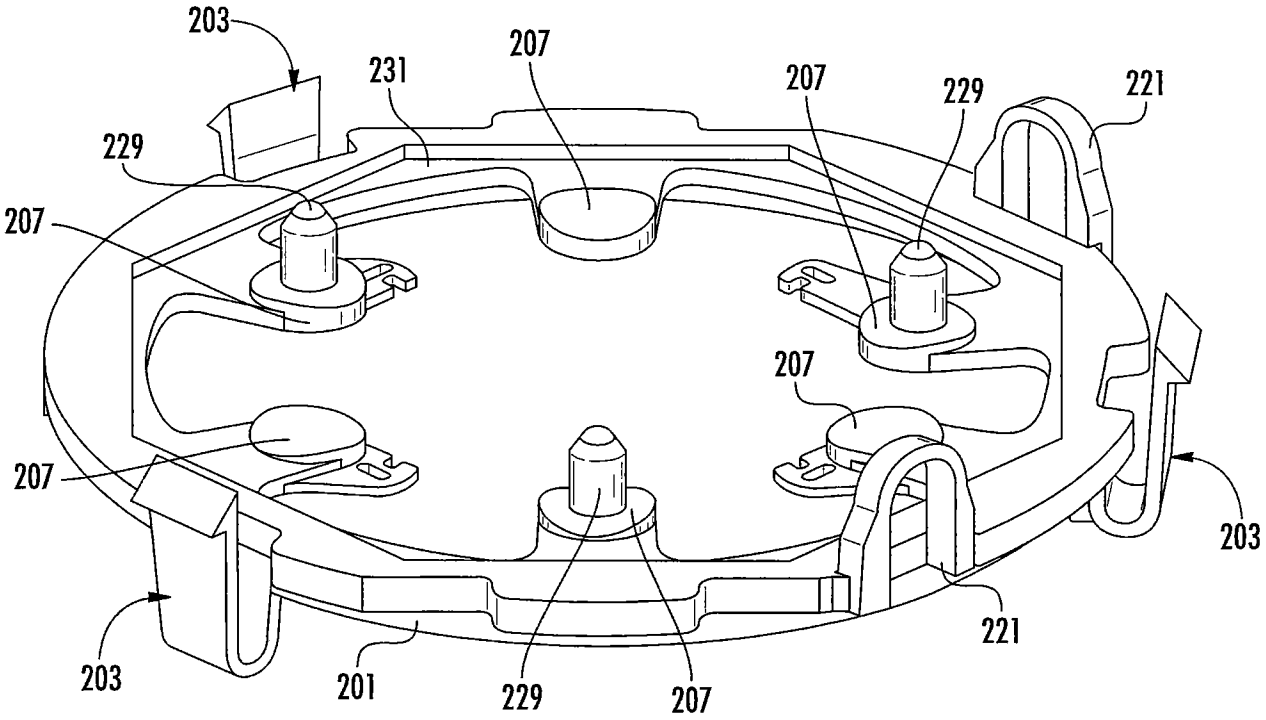
FIG. 7 is a perspective view of the underside of the clamp, according to an aspect of the present disclosure.

FIG. 7 is a perspective view of an underside (e.g., side opposite the top side) of the clamp 200 according to aspects of the present disclosure. As shown, along the outer periphery of the annular portion 201 are one or more cable guides 221. The one or more cable guides 221 may extend downward from a horizontal plane defined by the annular portion of the clamp 200. The one or more cable guides 221 may take the form of a loop, the aperture of which may be dimensioned to receive one or more cables 800. One end of one or more cables 800 may take the form of coaxial cables or other types, and may be connected to one or more of the radiating elements (an exemplary connection of which is shown in the underside of a reflector 206 of a base station antenna 11 in FIG. 8). Another end of the cables 800 may be coupled to one or more other components of the base station antenna 11 (e.g., one or more phase shifters, power divider networks and the like), or one or more components external to the base station antenna 11, such as a base station. To prevent unnecessary movement of the cables 800 within the base station antenna 11, the cable guides 221 may restrain or otherwise confine one or more ends of the one or more cables 800 to the area of the aperture.

Figure 9:
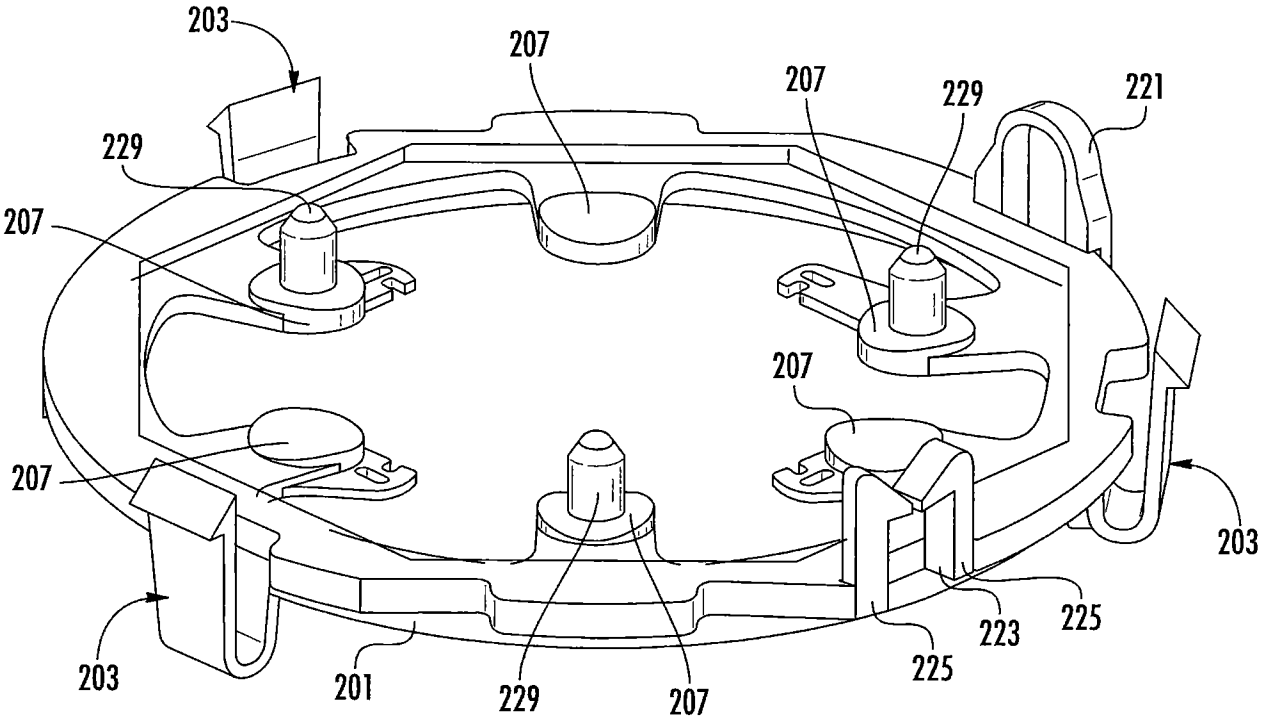
FIG. 9 is a perspective view of the underside of the clamp with an alternative cable guide construction, according to an aspect of the present disclosure.

Although the cable guides 221 in FIG. 7 are shown as loops, the cable guides 221 may take other forms in keeping with the spirit of the disclosure. For example, as shown in FIG. 9, one or more cable guides 223 may include a plurality of fingers 225 protruding from the horizontal plane defined by the annular portion 201. One end of the fingers 225 may include portions extending towards each other. Similar to the purpose of the cable guides 221, the one or more cable guides 223 may also serve to restrain the one or more cables 800 to the space between the fingers 225. It should be noted that the clamp 200 may include any combination of cables guides 221 and 223. For example, the clamp 200 may include all clamp guides 221, all clamp guides 223, or any combination of the same. It also should be noted that the clamp 200 may include more than two cables guides, 221 and/or 223 in keeping with the disclosure.

Referring back to FIG. 7, a plurality of clamp arms 207 may extend axially from the inner periphery of the annular portion 201. The clamp arms 207 may be biased to press against a baseboard 217 of the radiating element 208. Such a force may preferably be greater than 10 Newtons (1 kg) against the baseboard 217; however, other amounts of force may be applied in keeping with the disclosure. For example, other forces may be achieved by a level of the interference between the baseboard 217 and the clamp arms 207, or by changing the percentage of glass fiber in the resin of the clamp 200. A portion of each of the clamp arms 207 may include locating pins 229, which may extend downward with respect to the annular portion 201.

Referring to FIG. 7 and FIG. 10 showing the underside of the clamp with the radiating element 208 attached thereto, the inner periphery may include a stepped portion 231 which may include a plurality of sides defining a polygonal portion dimensioned to engage a shape of the perimeter of the baseboard 217 of the radiating element 208. The polygonal portion may serve to prevent unwanted rotation of the baseboard 217 within the clamp 200. Even though the stepped portion 231 is shown as a generally octagonal shape, any shape dimensioned to clear a perimeter of the baseboard 217 of the radiating element 208 may be contemplated in keeping with the disclosure. The depth of the stepped portion 231 may allow sufficient clearance of the baseboard 217 with the plurality of clamp arms 207. Further, a portion of one or more of the clamp arms 207 may include a locator pin 229 having an elliptical portion allowing for sufficient room for the clamp arms 207 biased against the baseboard 217. Each of the locator pins 229 may be configured to be inserted into an opening of the baseboard 217 to, along with the afore discussed securing members 203 and stepped portion 231, to locate, or otherwise secure the radiating element 208 against the reflector 206.

In light of the above discussion, aspects of the present disclosure are directed a single clamp 200 for securing the radiating element 208 to one or more components (e.g., a reflector 206) of a base station antenna 11. For ease of use and attachment to the reflector 206, the clamp 200 may be pre-assembled to the radiating element 208. As such, the clamp 200, along with the radiating element 208, may be ready for attachment to the reflector 206. FIG. 11 is an example perspective view of a plurality of clamps 200 including radiating elements 208 attached to the reflector 206.

Various embodiments of the disclosure have now been discussed in detail; however, the disclosure should not be understood as being limited to these embodiments. It should also be appreciated that various modifications, adaptations, and alternative embodiments thereof may be made within the scope and spirit of the present disclosure.

The invention claimed is:

1. A clamp for attaching a radiating element to a reflector of an antenna, comprising:

a generally annular portion;

a plurality of arms extending radially inwardly from the generally annular portion and configured to provide positive pressure between a printed circuit baseboard of the radiating element and the reflector;

a stepped portion in the generally annular portion dimensioned to clear sides of the printed circuit baseboard; and one or more securing members mounted to the generally annular portion configured to secure the clamp to the reflector.

2. The clamp defined in claim 1, further comprising a plurality of cable guides mounted to the generally annular portion.

3. The clamp defined in claim 1, wherein each of the arms includes a notch configured to receive a printed circuit board of the radiating element.

4. The clamp defined in claim 1, mounted on a reflector.

5. The clamp defined in claim 2, further comprising cables secured by the cable guides.

6. The clamp defined in claim 1, in combination with a radiating element mounted thereto.

7. The combination defined in claim 6, mounted on a reflector.

8. The combination defined in claim 7, wherein the clamp further comprises a plurality of cable guides mounted to the generally annular portion that extend through the reflector, and wherein the combination further comprises cables secured in the cable guides.

* * * * *